United States Patent [19]

McDuff et al.

[11] Patent Number: 4,712,502

[45] Date of Patent: Dec. 15, 1987

[54] SEAL PAC DIAPER

[76] Inventors: George L. McDuff; Bobby G. McCoy, both of 308 E. Verdine St., Sulphur, La. 70663

[21] Appl. No.: 904,712

[22] Filed: Sep. 8, 1986

[51] Int. Cl.[4] ..... B63B 43/16

[52] U.S. Cl. ..... 114/229

[58] Field of Search ..... 114/227-229; 405/12; 220/230, 232

[56] References Cited

U.S. PATENT DOCUMENTS

| | | | |
|---|---|---|---|
| 1,221,496 | 4/1917 | Wallyamoz et al. | 114/227 |
| 1,735,461 | 11/1929 | Haupt | 220/232 X |
| 2,446,190 | 8/1948 | Oding | 114/227 |
| 3,329,121 | 7/1967 | Ulrich et al. | 114/227 |
| 3,857,249 | 12/1974 | Kelly et al. | 61/68 |
| 4,175,510 | 11/1979 | Devine | 114/227 |
| 4,362,437 | 12/1982 | Leary | 405/188 |
| 4,569,303 | 2/1986 | McDuff et al. | 114/227 |

FOREIGN PATENT DOCUMENTS

| | | | |
|---|---|---|---|
| 115754 | 5/1918 | United Kingdom | 114/229 |

*Primary Examiner*—Sherman D. Basinger
*Attorney, Agent, or Firm*—Warren H. Kintzinger

[57] ABSTRACT

A lipped mouth seal structure with inflated lips mounting a sponge rubber type seal engaging the side of a large container tank or ship such as an oil tanker around an area of puncture or rupture with the lips generally rectangular about an area enclosed thereby. The lips and the area within the lips is spanned by a leak proof flexible membrane overlying the back sides of the lips. The lips underlie, at the top and bottom of the seal structure, transverse cross brace bars retained in rearwardly extended sleeves of the seal structure. The lips are in the form of inflatable rings of rubber (natural rubber, synthetic rubber or rubber-like plastic) mounting the resiliently deflectable sponge rubber type seal on the front ship facing side of lips with the sponge rubber seal along with the inflatable rings resiliently deflectable to conform to ship outer surface irregularities in providing sealed containment about a ship skin rupture opening. Vertically oriented straps overlie the backs of the opposite side sections of the inflatable rings pass through the uppermost and the bottom transverse cross brace bars to strap end to cable connectors and with the straps passed through individual vertically extended sleeves on the back of seal structure between the upper and lower transverse cross brace bars. Cables extending from a winch structure on the deck of a ship extend on one side to connection with a top cable connection and on the other side down under the ship and then up to the bottom cable connectors on the seal structure.

17 Claims, 9 Drawing Figures

SEAL PAC DIAPER

BACKGROUND OF THE INVENTION

This invention relates in general to ship cargo leak prevention devices, and more particularly, to a lipped mouth seal diaper useful in packing a a rupture hole in a vessel side to prevent outflow of crude oil or refined petroleum products or other liquid cargo from a tanker or inflow of sea water into a ship.

Loaded tanker ships on the high seas occasionally encounter trouble, collision between ships, deep draft heavily loaded tankers with underwater channel obstacles, and running aground with rupture tears and holes being punched in the vessels such as to cause leakage. Such petroleum leakage can be quite costly not only in product lost but also in contamination of sea waters, beaches and marsh lands and is severely damaging to sea life. Further, leakage of oil and petroleum products can constitute a severe fire hazard leading with explosions to destruction of some vessels and loss of life. The disastrous consequences of such accidents can be minimized or eliminated through effective containment and recovery of such products leaking from a damaged ship.

It is, therefore, a principal object of this invention to minimize and stop loss of fluid cargo leaking from a ruptured ship.

Another object is to prevent contamination of the sea, beaches and marsh lands and harm to sea life.

A further object is to minimize the danger of fire and explosions with leaking inflammable fluids.

Still another object is to minimize the hazards to sea vessel navigation and travel.

Another object is to enable a sea vessel to again get underway after vessel side wall rupture hole damage has occurred.

SUMMARY OF THE INVENTION

Features of the invention useful in accomplishing the above objects include, in a seal pac diaper for sea vessels for ruptured tankers and other vessels, a multi-lipped mouthed seal structure with flexible inflatable lips mounting a resiliently deflectable sponge rubber (or its functional equivalent) rectangular seal ring on the collective lip forward face that with the resilient backing of the inflated lips conforms to the outer surface irregularities of a ship's side. A leak proof flexible membrane spans the inner area enclosed by the inflatable lips and extends over the back surface of the lips to which it is fastened as by being bonded. A pair of transverse cross brace bars are utilized both at the top of the seal diaper structure and a pair of such bars are also used at the bottom thereof held in rearwardly extended sleeves to the back of the top and bottom horizontally extended portions of the lips and of the membrane. Vertically oriented straps overlying the backs of the opposite side vertical portions of the lips extend through vertically extended sleeves in the back of the membrane and on through openings therefor through the uppermost and lowermost transverse cross brace bars to strap end to cable connectors adjacent to the outer side of respective transverse cross brace bars. Vertically extended channels overlie both the backs of the opposite side vertical portions of the lips and the straps and are quickly fastened in place on bolt studs mounted on end cut-outs in the innermost transverse cross brace bars at the top and bottom of the seal structure as by wing nuts. A sheave stand off stanchion is provided in the middle of each vertically extended channel whereby cables run under the ship and over the pulleys could be tightened to help push the seal structure more tightly against the side of the ship for more secure seal engagement particularly in planar flat surface areas of the ship where a rupture may have occurred. A relatively stiff shell cover, that may be a fiber glass shell is provided for placement over the seal structure and mounted in place on a ship side with bolt studs welded in place on the ship side extended through cover flanges for the mounting thereof. The shell cover not only shields the seal structure but also minimizes or eliminates any fluid flow created venturi forces for originated pulling forces being imposed directly on the seal structure as a ship is under way. It permits a ship, reasonably, to get under way after a seal diaper has been installed in place over a ship rupture opening with minimal time loss and in a relatively safe manner.

A specific embodiment representing what is presently regarded as the best mode of carrying out the invention is illustrated in the accompanying drawings.

In the drawings:

FIG. 1 represents a perspective view of a floating ship with a lipped mouth seal diaper positioned in place enclosing a ship side rupture opening and the cable and winch system that positions and holds the seal diaper properly in place on the ship side;

FIG. 2, on elevation view of the seal diaper from the back membrane side;

FIG. 3, a broken away and sectioned view taken along line 3—3 of FIG. 2 showing detail of a transverse spacer bar and "T" end to membrane connection;

FIG. 4, a partially broken away exploded perspective view showing transverse bar and vertical channel detail in the seal structure of FIGS. 1 and 2;

FIG. 5, a broken away and sectioned view taken along line 5—5 of FIG. 2 showing channel, belt, membrane, stanchion sheave, inflatable seal and foam lip detail;

FIG. 6, a partial broken away and sectioned enlarged perspective view showing cross bar, belt and belt end to cable connector detail similar to a portion of FIG. 4;

FIG. 7, a perspective view of a floating ship with a protective cover mounted in place over a seal diaper mounted on the ship side to permit the ship to be underway;

FIG. 8, a section view taken from line 8—8 of FIG. 7 showing additional protective cover and seal diaper detail; and FIG. 9, a perspective view of a floating ship with a seal diaper installed over a rupture opening in the ship side in line with superstructure of the ship and the cable, cable pulley, and winch system therefore.

Referring to the drawings:

DETAILED DESCRIPTION OF THE INVENTION

Figure 1:
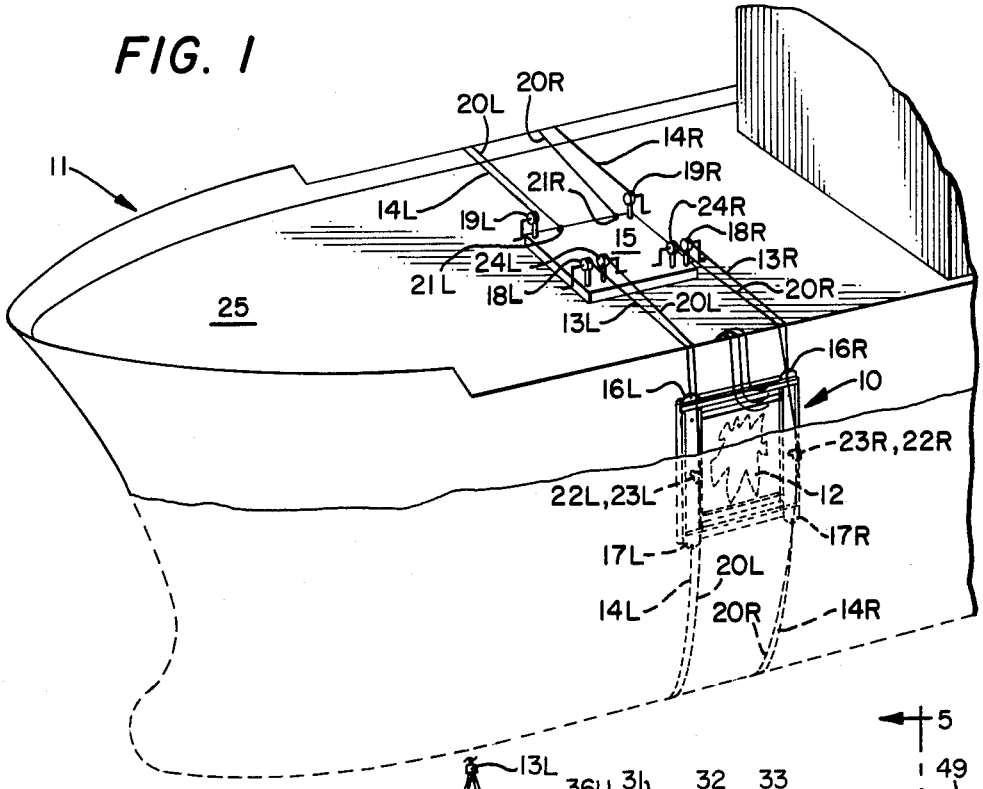

The ship fluid cargo seal diaper 10 is shown in FIG. 1 to be installed on the side wall of a sea vessel 11 positioned and held in place thereon over and encompassing a rupture opening 12 by a plurality of cables 13L and 13R, and 14L and 14R extended from winch platform 15 to connection with individual upper and lower strap end to cable connectors 16L and 16R, and 17L and 17R. Winches 18L and 18R, and 19L and 19R are provided on the winch platform 15 for, respectively, cables 13L and 13R, and 14L and 14R. Cables 20L and 20R are also provided that have connections 21L and 21R to winch platform 15 at one end, run under the ship 11 and up over sheaves 22L and 22R, mounted on stand off stanchions 23L and 23R, and on to windup connection with winches 24L and 24R mounted on winch platform 15. It should be noted that the winch platform 15 is movable about the deck 25 of a ship 11 without being fastened down to adapted to different seal diaper 10 positioning as required.

With reference also to FIGS. 2–6 the seal diaper 10 is a multi-lip mouthed seal structure with three side by side flexible inflatable lip generally rectangular rings 26, 27 and 28 generally in concentric relation that while flexible in adapting to any curves or irregularities in the side of a ship they lend lateral support one to the other. The rectangular side by side rings 26, 27 and 28 in their collective structural inflated rectangular shape present upper and lower portions and opposite left and right side portions all together enclosing an area sized to encompass a vessel side wall rupture opening. This rupture opening is closed by the seal diaper 10 with a leak proof flexible membrane 29 overlying and bonded to the collective back sides of the inflatable lip rings 26, 27 and 28, and spanning the rectangular area enclosed by the rectangular shape of the lip rings. The collective front sides of the inflatable lip rings 26, 27 and 28 mount a sponge rubber type seal 30 of rectangular shape matching the rectangular shape of the lip rings 26, 27 and 28, and bonded to the front vessel facing side thereof. The resiliently compressible sponge rubber type seal 30 that may be a resiliently compressible foamed rubber or synthetic material aids in adapting to curves and irregularities in the side of a ship with the seal 30 along with the inflatable rings 26, 27 and 28 resiliently deflectable together in conforming to ship outer surface irregularities in providing sealed containment about a ship skin rupture opening 12, the inflatable lip rings 26, 27 and 28 are individually inflated through air supply lines 31, 32 and 33, respectively, and are sealed one from the other so that if one of the rings 26, 27 and 28 is ruptured and loses air pressure the other two are still adequate to do the sealing structural function required.

A pair of transverse cross brace bars 34U and 35U are used at the top of seal diaper structure 10 held in rearwardly extended sleeves 36U and 37U from the leak proof flexible membrane 29 and to the back of the top horizontally extended portion of the inflatable lip rings 26, 27 and 28. A like pair of transverse cross brace bars 34L and 35L are used at the bottom of seal diaper structure 10 held in rearwardly extended sleeves 36B and 37B from the leak proof flexible membrane 29 and to the back of the bottom horizontally extended portion of the inflatable lip rings 26, 27 and 28. Tie down strapping such as strap 38 on sleeve 36U and 39 on sleeve 37U are provided for air supply lines 31, 32 and 33 to minimize line pull on the line fittings 40, 41 and 42 for the inflatable rings 26, 27 and 28, respectively. Vertically oriented straps 43 and 44 provided as a pair on both sides of seal diaper structure 10 overlie the backs of the opposite side vertical portions of the lip rings 26, 27 and 28 and pass through vertically extended sleeves 45 and 46 in the back of the membrane 29 and on through openings 47 and 48 therefore through the uppermost and lower most transverse cross brace bars 34U and 34L, respectively. The straps 43 and 44 extend to strap end to cable connectors 49 all four of which are identical being a common for each end of each pair of straps 43 and 44 each with a pinned 50 and staked 51 connection adjacent the outer sides of transverse cross brace bars 34U and 34L. Duplicate vertically extended channels 52 are provided that overlie the backs of the opposite side vertical portions of the lips 26, 27 and 28 and the straps 43 and 44 and are quickly fastened in place on bolt studs 53 by wing nuts 54. Bolt studs 53 extend through bottom opposite side extensions 55, of transverse cross brace bars 35U and 35L, that extend the width of vertically extended channels 52, the respective channel 52 and a reinforcing beam section 56 welded in place on opposite ends of vertically extended channels 52 as a part of the channel structure that extends at right angle into the rectangular interior of hollow transverse cross brace bars 34U and 34L, respectively. It should be noted that in many cases where the seal diaper 10 is installed in place over a rupture opening 12 in a convex surface area of a ship 11 instead of a flat surface area the seal diaper 10 would generally be used without the vertically extended channels 52 being installed. However, when a seal diaper 10 is used on a flat (or relatively flat) ship surface channels 52 would be used in order to obtain more sealing force against the ship side through the vertical extent of the seal diaper structure. Stanchions 23L and 23R mounted in the middle of each vertically extended channel 52 extend outwardly to the rear therefrom and mount at their outer ends sheaves 22L and 22R in order that cables 20L and 20R when tightened in place on sheaves 22L and 22R by winches 24L and 24R from winch platform 15 exert inward force on the channels 52 and thereby increased sealing force on seal diaper 10.

Figure 2:
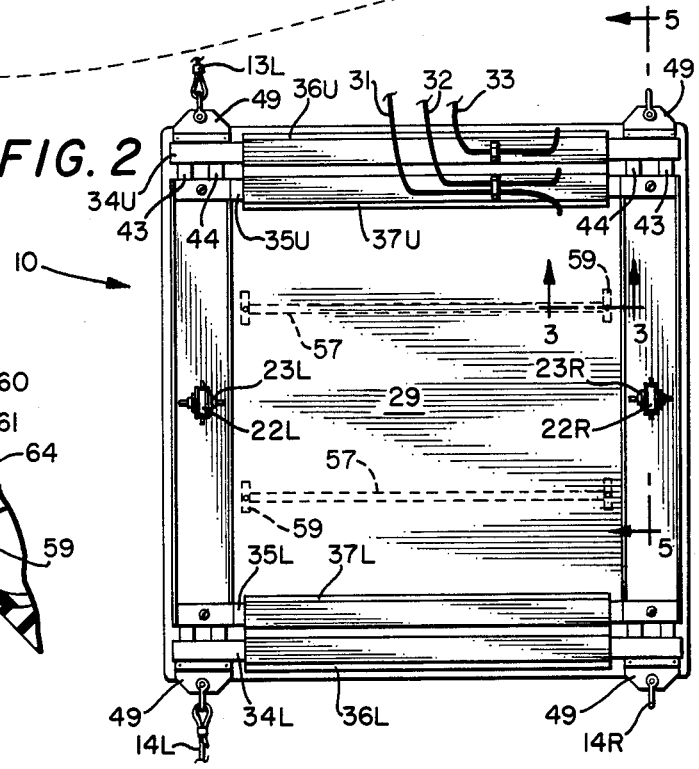
Figure 3:
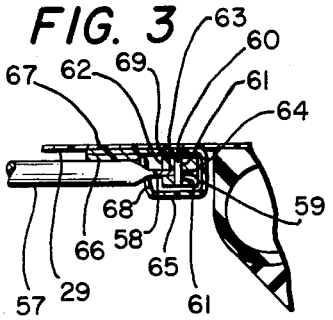
Figure 4:
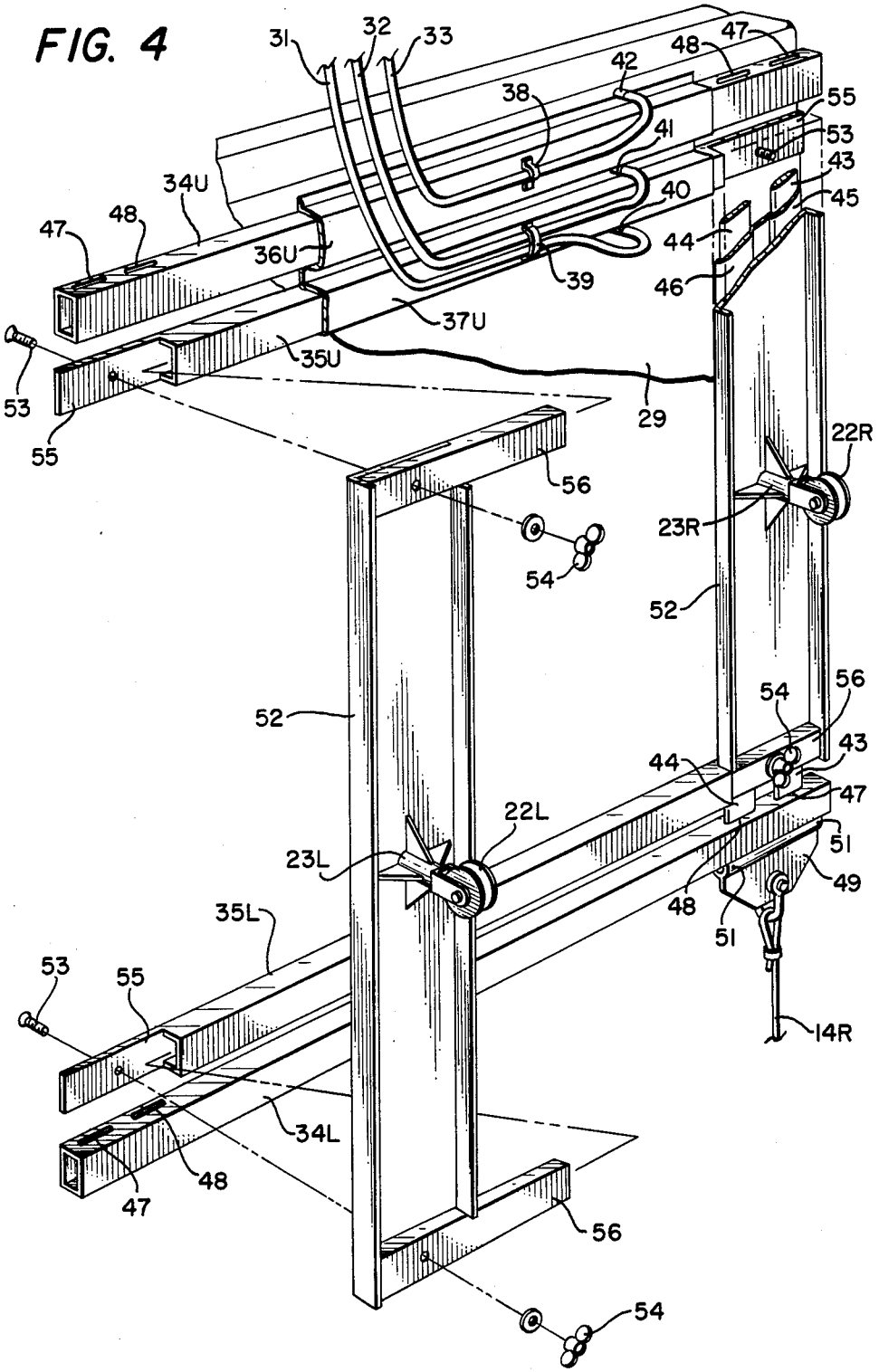
Figure 5:
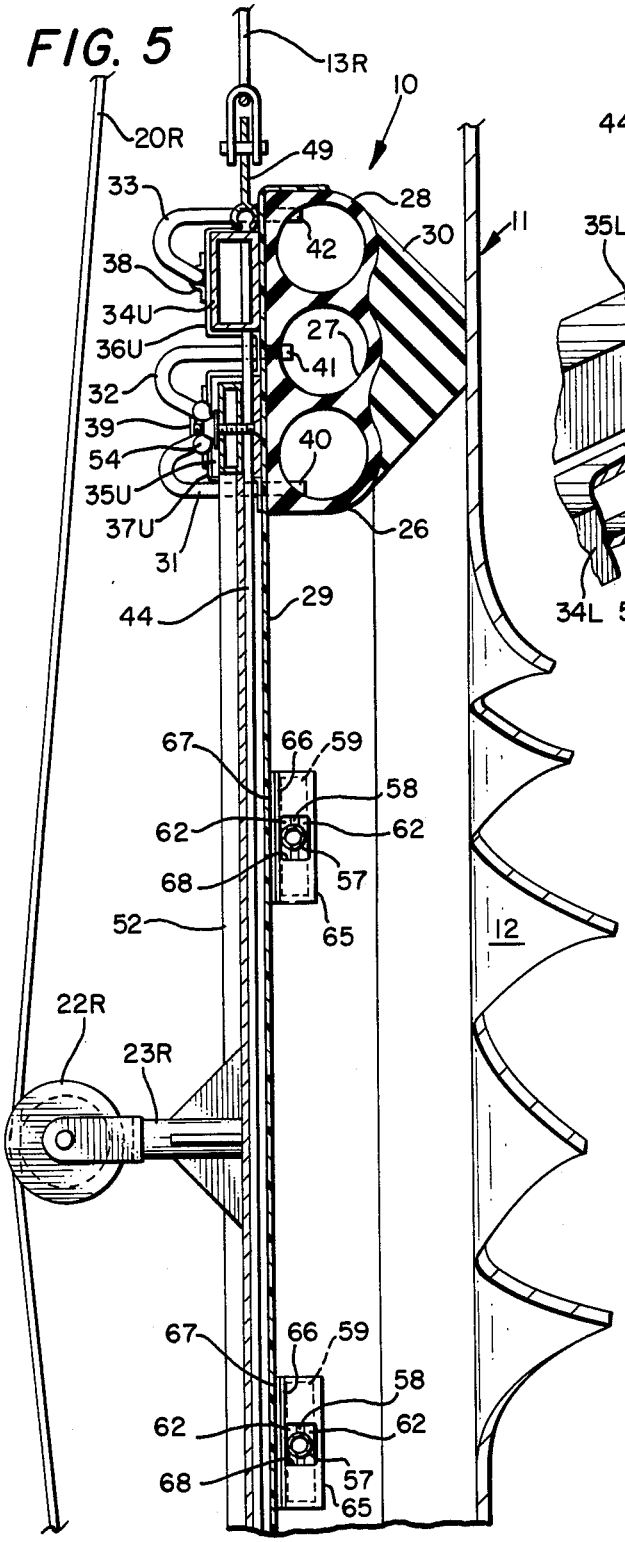
Figure 6:
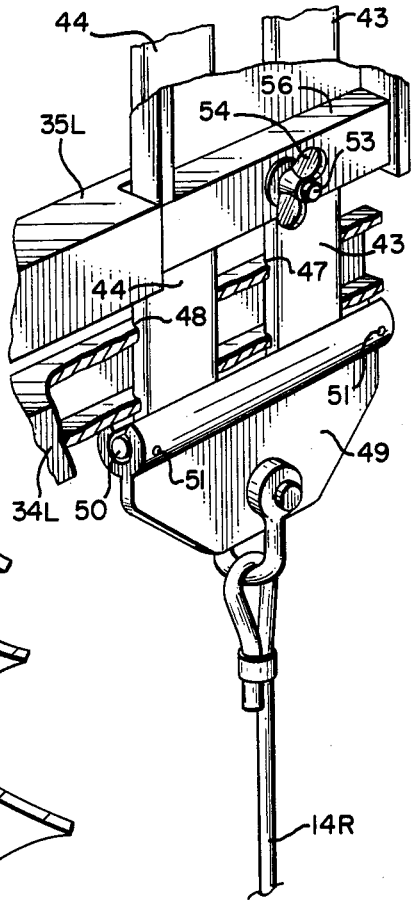

Seal diapers 10 will be available in a range of effective enclosed areas within the rectangular side by side rings 26, 27 and 28 typically 3×3 feet, 3×5 feet and 4×6 feet with these being adequate to seal off, respectively, 79% 90% and 97% of ship and barge rupture holes encountered. In order to counter inward pulling forces imposed on the opposite side vertical portions of the rectangular side by side rings 26, 27 and 28 along with the sponge rubber type seal 30 interim transverse cross brace bars 57 are provided, such as shown in FIGS. 2 and 3, inside of the membrane 29. Transverse cross brace bars 57 are tubular with flattened ends 58 that respectively mount "T" bar end members 59 with a pin 60 that while fixed in the opposite side openings 61 of the opposite sides 62 of a slot 63 in the middle of each member 59 is a pivot fit in opening 64 in the respective bar flattened ends 58. This permits articulation of each "T" bar end member 59 in adapting to the orientation of the sleeve 65 each is held in to support the "T" bar members 59 and the transverse cross brace bars 57 when used in a seal diaper 10. Each sleeve 65 is made of flexible material with a looped sleeve pocket and with both end lengths 66 and 67 directed inwardly and bonded together and as a sleeve unit with bar opening 68 bonded to the inner surface 69 of membrane 29. while the seal diaper 10 is shown to be equipped with two interim transverse cross brace bars 57 small seal diapers 10 could be used and work satisfactorily without a cross bar 57 while larger seal diapers could have one or more interim transverse cross brace bars 57 as a function of size of the seal diapers 10.

Figure 7:
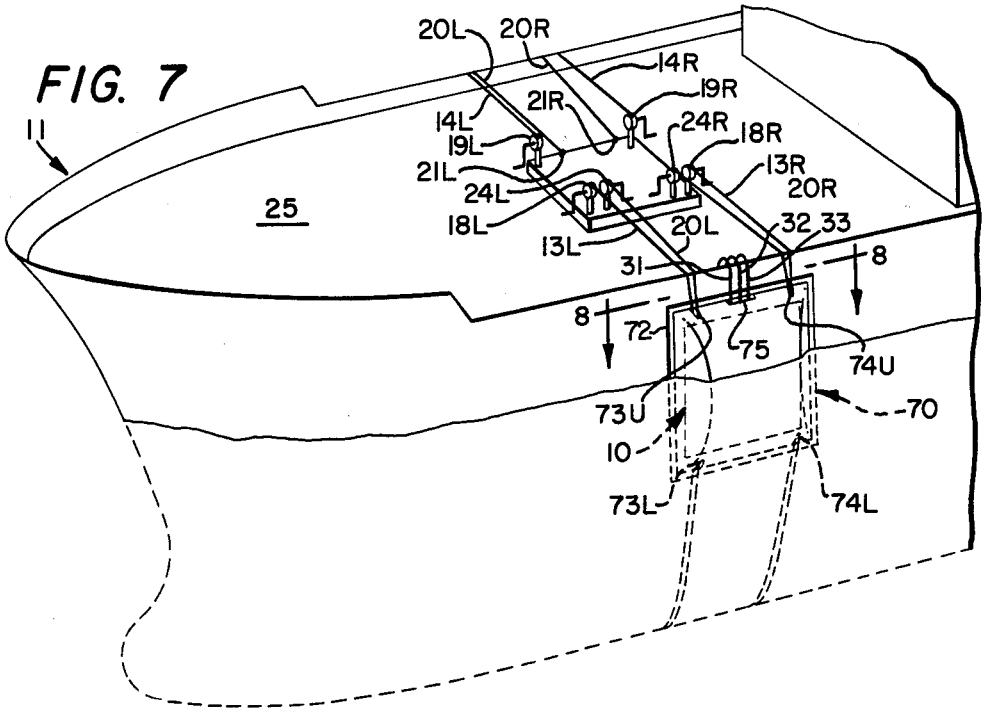
Figure 8:
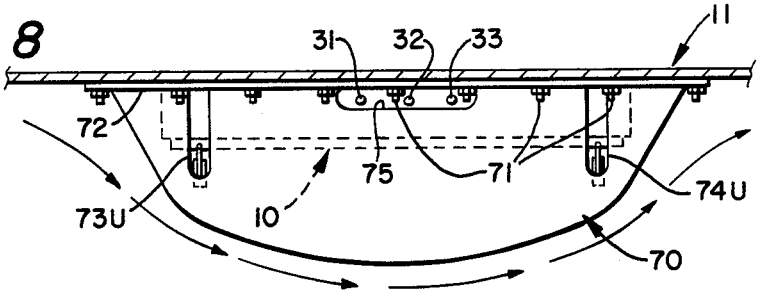

Referring now to FIGS. 7 and 8 a seal diaper 10 is mounted in place on the side of a ship 11 with a protective cover 70 mounted on the ship side over the seal diaper 10 to permit the ship to be underway. The protective cover 70 may be a fiberglass shell mounted in place on a ship side with bolt studs 71 quick welded in place on the ship side extended through cover peripheral mounting flange 72. The shell cover 70 not only shields the seal structure, but also minimizes or eliminates any fluid flow created venturi originated pulling forces being imposed directly on the seal diaper structure as a ship is under way. The shell cover 70 is slotted 73U and 74U, and 73L and 74L to accommodate the cables holding the seal diaper 10 in place and an opening 75 is provided for air lines 31, 32 and 33.

Figure 9:
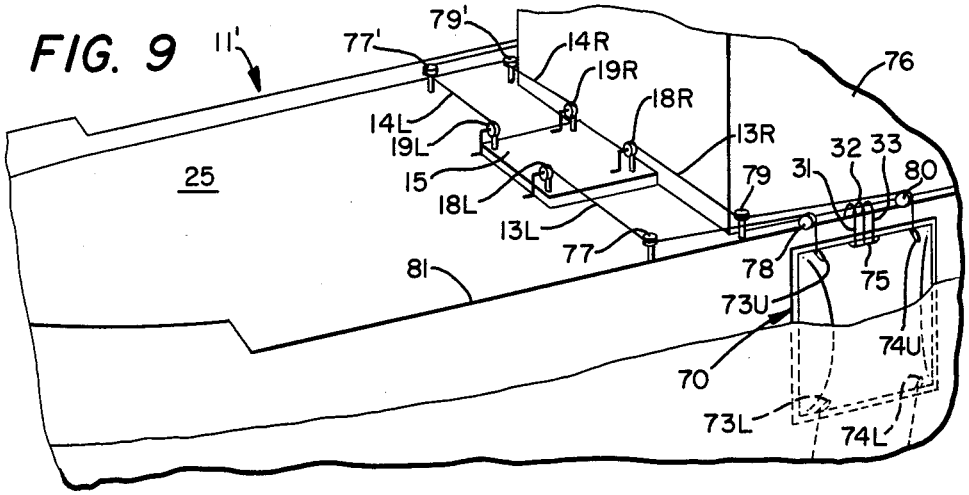

The illustration of FIG. 9 shows a floative ship 11' with, however a seal diaper 10 and protective shell cover 70 installed over a rupture opening in the ship side in line with superstructure 76 of the ship 11'. With this seal diaper placement the winch platform 15 cables 13L and 13R must be passed around pulleys 77, 78, 79 and 80, respectively, that are anchored in place at the side railing 81 for proper alignment with the seal diaper 10. In like manner cables 14L and 14R are passed around pulleys 77', 78' and (79' and 80' not appearing) for proper alignment under the ship with the seal diaper 10.

Whereas this invention has been described primarily with respect to a specific embodiment thereof, it should be realized that various changes may be made without departure from the essential contributions to the art made by the teachings hereof.

We claim:

1. A seal pack diaper for vessels including ships such as an oil tanker mountable about a ruptured opening in a wall of a vessel comprising: a lipped mouth seal structure with a plurality of inflated side by side lips that as a lip structure enclose a generally rectangular area and a flexible resiliently compressible material seal member mounted on the front face of said side by side lips for engaging the wall of a vessel around an area of rupture opening; a leak proof flexible membrane spanning the area enclosed by said side by side lips and overlying and bonded to the back side of said side by side lips; transverse cross brace bar means overlying the back of the top and bottom portions of said side by side lips and fastened to said leak proof flexible membrane; vertically oriented flexible strap means overlying the backs of the opposite side sections of said side by side lips; strap end to cable connector means connected to each end of said flexible strap means; and a cable system including cables connected to each of said strap end to cable connector means for positioning said seal pack diaper on a vessel wall over a ruptured opening in the vessel wall and to hold the diaper firmly in place over the ruptured opening in the wall; wherein said transverse cross brace bar means overlying the back of the top and bottom positions of said side by side lips includes at least one transverse cross brace bar at the top, and at least one transverse cross brace bar at the bottom of said seal structure; and said transverse cross brace bars are individually retained in rearwardly extended sleeves fastened to the seal structure; and wherein said vertically oriented flexible strap means overlying the backs of the opposite side sections of said side by side lips includes at least one vertically oriented flexible strap at each side of said seal pack diaper; and with said vertically oriented flexible straps each individually running through a vertically extended sleeve in the back of said seal structure.

2. The seal pack diaper of claim 1, wherein through opening means are provided in said transverse cross brace bars at the top and at the bottom of said seal structure; and with said vertically oriented flexible straps extended through said through opening means of both the top and bottom transverse cross brace bars.

3. The seal pack diaper of claim 2, wherein said rearwardly extended sleeves are bonded to the rear of said leak proof flexible membrane; and said vertically extended sleeves are sleeves on the back of said leak proof flexible membrane.

4. The seal pack diaper of claim 2, wherein interim transverse cross brace bar means is mounted inside of said leak proof flexible membrane; a "T" top bar member connected to each interim transverse cross brace bar end; flexible material formed sleeves bonded to the interior front face of said leak proof flexible membrane inboard from and adjacent to the innermost side of the innermost of said side by side lips holding said "T" top bar members and interim transverse cross brace bar means interconnecting said "T" top bar members; opening means in said flexible material formed sleeves for said interim transverse cross brace bar means; and interim transverse cross brace bar means to "T" top bar member interconnect means.

5. The seal pack diaper of claim 4, wherein said interim transverse cross brace bar means is a plurality of interim transverse cross brace bar means mounted inside of said leak proof flexible membrane.

6. The seal pack diaper of claim 4, wherein each of said interim transverse cross brace bar means to "T" top bar member interconenct means is a pivot connection.

7. The seal pack diaper of claim 2, wherein said transverse cross brace bar means includes, a pair of transverse cross brace bars overlying the back of the top portion and a pair of transverse cross brace bars overlying the back of the bottom portion of said side by side lips.

8. The seal pack diaper of claim 7, wherein a vertically extended channel overlies both backs of the opposite side vertical portions of said side by side lips and said vertically oriented flexible straps; and fastening means for mounting both of said vertically extended channels on opposite ends of the innermost transverse cross brace bar of the pair of bars overlying the back of the top portion of said side by side lips, and on opposite ends of the innermost transverse cross brace bar of the pair of bars overlying the back of the bottom portion of said side by side lips.

9. The seal pack diaper of claim 8, wherein said transverse cross brace bars are hollow rectangular bars; and opposite ends of said innermost transverse cross brace bar of both pairs of bars are cut away to present back opposite and extensions over which said vertically oriented flexible straps run and to receive opposite ends of said vertically extended channels over said vertically oriented flexible straps.

10. The seal pack diaper of claim 9, wherein a sheave stand off stanchion is provided in the middle of each vertically extended channel each mounting a sleeve pulley; and cables run under the vessel and over the sheave pulleys to be tightened to help push the seal structure more tightly against the side of the vessel for more secure seal engagement particularly in planar flat surface areas of the vessel where a rupture opening may be located.

11. The seal pack diaper of claim 9, wherein a reinforcing beam section is fastened in place on each end of each of said vertically extended channels to extend inboard for a length insertable into the rectangular interior at the respective ends of said hollow transverse cross brace bars upon assembly of said vertically extended channels in a seal diaper structure.

12. The seal pack diaper of claim 11, wherein said fastening means for mounting of said vertically extended channels on opposite ends of both innermost transverse cross brace bars include, bolt studs extended through the opposite ends of said innermost transverse cross brace bars, through said vertically extended channels, and through a reinforcing beam section; and a nut on each bolt stud.

13. The seal pack diaper of claim 12, wherein said vertically oriented flexible strap means overlying the back of each opposite side section of said side by side lips is a pair of spaced parallel flexible straps; said strap end to cable connector means includes a common connector at each end of each said pair of spaced parallel flexible straps; and with said straps of a length matched to said lip structure and seal structure size with said strap end to cable connector means adjacent the outer side of the respective top and bottom transverse cross brace bars.

14. The seal pack diaper of claim 13, wherein each of said bolt studs pass between spaced parallel flexible straps of the pair of straps extended over end extensions of said innermost transverse cross brace bars.

15. The seal pack diaper of claim 14, wherein said nut is a wing nut that tightens down on each of said bolt studs against the respective reinforcing beam section.

16. A seal pack diaper for vessels including ships such as an oil tanker mountable about a ruptured opening in a wall of a vessel comprising: a lipped mouth seal structure with a plurality of inflated side by side lips that as a lip structure enclose a generally rectangular area and a flexible resiliently compressible material seal member mounted on the front face of said side by side lips for engaging the wall of a vessel around an area of rupture opening; a leak proof flexible membrane spanning the area enclosed by said side by side lips and overlying and bonded to the back side of said side by side lips; transverse cross brace bar means overlying the back of the top and bottom portions of said side by side lips and fastened to said leak proof flexible membrane; vertically oriented flexible strap means overlying the backs of the opposite side sections of said side by side lips; strap end to cable connector means connected to each end of said flexible strap means; and a cable system including cables connected to each of said strap end to cable connector means for positioning said seal pack diaper on a vessel wall over a ruptured opening in the vessel wall and to hold the diaper firmly in place over the ruptured opening in the wall; wherein said cable system includes a cable winch platform moveable about a vessel deck; a plurality of cable winches mounted on said winch platform for individual cables connected to said seal pack structure for positioning of the seal pack structure and tightening of the seal pack structure in place over a vessel rupture opening; a protective cover is mounted on a ship side over a seal pack structure to permit the ship to be underway; mounting means mounting said protective cover in place on the ship side; and opening means in said protective cover for cable and air line passage from outside said protective cover to said seal pack structure.

17. The seal pack diaper of claim 16, wherein pulley means are mounted at side railings of a ship to accommodate seal pack structure placement over a vessel rupture opening in line with superstructure of the ship.

* * * * *